US008436673B2

(12) United States Patent
Miyazawa

(10) Patent No.: US 8,436,673 B2
(45) Date of Patent: May 7, 2013

(54) SEMICONDUCTOR APPARATUS EXHIBITING CURRENT CONTROL FUNCTION

(75) Inventor: Shigemi Miyazawa, Matsumoto (JP)

(73) Assignee: Fuji Electric Co., Ltd. (JP)

( * ) Notice: Subject to any disclaimer, the term of this patent is extended or adjusted under 35 U.S.C. 154(b) by 13 days.

(21) Appl. No.: 13/204,330

(22) Filed: Aug. 5, 2011

(65) Prior Publication Data

US 2012/0033341 A1 Feb. 9, 2012

(30) Foreign Application Priority Data

Aug. 9, 2010 (JP) ..... 2010-178317

(51) Int. Cl.
*H03K 17/04* (2006.01)

(52) U.S. Cl.
USPC ..... 327/374; 327/376; 327/377; 327/389

(58) Field of Classification Search ..... 327/365–508
See application file for complete search history.

(56) References Cited

U.S. PATENT DOCUMENTS 7,795,949 B2 * 9/2010 Fischer et al. ..... 327/427
8,217,704 B2 * 7/2012 Kohama et al. ..... 327/378
2008/0211567 A1 * 9/2008 Morita et al. ..... 327/425
2009/0066400 A1 * 3/2009 Fischer et al. ..... 327/375
2012/0215431 A1 * 8/2012 Miyazawa ..... 701/115

FOREIGN PATENT DOCUMENTS

JP 2001-153012 A 5/2001
JP 2002-004991 A 1/2002
JP 2002-371945 A 12/2002

* cited by examiner

*Primary Examiner* — Lincoln Donovan
*Assistant Examiner* — Brandon S Cole
(74) *Attorney, Agent, or Firm* — Rossi, Kimms & McDowell LLP

(57) ABSTRACT

An ignitor semiconductor apparatus can include an output stage IGBT that controls the ON and OFF of the primary current of ignition coil, a sensing IGBT and a sensing resistance for detecting the current flowing through output stage IGBT, gate resistance and a current control circuit that detects the voltage across sensing resistance and controls the current flowing through output stage IGBT. First and second gate control circuits separately control the gate voltages of IGBT's such that the gate voltage of the output stage IGBT is higher than the gate voltage of the sensing IGBT, when the current flowing through output stage IGBT is larger than a predetermined current value, and such that the gate voltage of output stage IGBT is lower than the gate voltage of sensing IGBT, when the current flowing through output stage IGBT is smaller than the predetermined current value.

8 Claims, 4 Drawing Sheets

SEMICONDUCTOR APPARATUS EXHIBITING CURRENT CONTROL FUNCTION

BACKGROUND

1. Field of the Invention

Embodiments of the invention relate to semiconductor apparatuses used as ignition systems for the internal combustion engines on automobiles. Specifically, embodiments relate to semiconductor apparatuses exhibiting a current control function.

2. Description of Related Art

A semiconductor apparatus, which incorporates therein a power semiconductor device for controlling the switching of a current on the primary side of an ignition coil, is used for the ignition system of an internal combustion engine for automobiles. FIG. 5 shows a general configuration example of a conventional semiconductor apparatus used as an ignition system for the internal combustion engines. The semiconductor apparatus shown in FIG. 5 employs an insulated gate bipolar transistor (hereinafter referred to as an "IGBT") as a power semiconductor device.

The ignitor semiconductor apparatus shown in FIG. 5 includes electronic engine control unit (hereinafter referred to as "ECU") 1, ignitor semiconductor integrated circuit (hereinafter referred to as "IC") 2, ignition coil 3, voltage source 4, and spark plug 5.

IC 2 includes, in the output stage thereof, output stage IGBT 11 that controls the ON and OFF of the primary current of ignition coil 3. IC 2 further includes sensing IGBT 12 for detecting a sensing current, the collector and gate thereof are connected in common to the collector and gate of output stage IGBT 11, respectively; sensing resistance 13 for detecting the sensing current; gate resistance 14; and current control circuit 10 that controls the collector current of output stage IGBT 11. IC 2 further includes three terminals; C terminal (collector electrode), E terminal (emitter electrode), and G terminal (gate electrode). C terminal is connected to ignition coil 3, E terminal to the earth potential, and G terminal to ECU 1.

Now the operations of the ignitor semiconductor apparatus shown in FIG. 5 will be described below.

ECU 1 feeds the signal, which controls the ON and OFF of output stage IGBT 11 in IC 2, to G terminal. For example, as a voltage of 5 V is fed to G terminal, output stage IGBT 11 is turned ON. As a voltage of 0 V is fed to G terminal, output stage IGBT 11 is turned OFF.

As an ON-signal is fed from ECU 1 to G terminal, output stage IGBT 11 in IC 2 is turned ON and a collector current Ic starts flowing to C terminal of IC 2 from voltage source 4 (e.g. 14 V) via primary coil 6 in ignition coil 3. The dl/dt of the collector current Ic is determined by the primary coil 6 inductance and the applied voltage. After the collector current Ic increases to a constant current value (e.g., 13 A) controlled by current control circuit 10, the collector current Ic keeps the constant current value.

As an OFF-signal is fed to the G terminal from ECU 1, output stage IGBT 11 in IC 2 is turned OFF and the collector current Ic decreases rapidly. By the rapid Ic change, the voltage across primary coil 6 rises rapidly. At the same time, the voltage across secondary coil 7 rises to several tens kV. (e.g. 30 kV) and the rising voltage is applied to spark plug 5. Spark plug 5 discharges, as the voltage applied thereto exceeds 10 kV to the higher side.

When an ON-signal is fed from ECU 1 for a predetermined period or longer or when the IC 2 temperature is higher than a predetermined temperature, a circumstance in that ignition coil 3 or IC 2 may burn, a self-interrupter circuit incorporated in current control circuit 10 will work to interrupt the collector current Ic. However, if the collector current Ic is interrupted suddenly, spark plug 5 will discharge at a timing not set in advance, and the engine will be damaged. Therefore, it is beneficial to control the dl/dt of the collector current Ic within the range, in which spark plug 5 does not malfunction to spark.

FIG. 6 is a circuit diagram showing the circuit configuration of current control circuit 10.

Current control circuit 10 shown in FIG. 6 is driven by the voltage between G and E terminals. Current control circuit 10 includes reference voltage circuit 31, level shift circuits 32 and 34, self-interrupter circuit 33, comparator circuit 35, and metal-oxide-semiconductor field-effect transistor (hereinafter referred to as "MOSFET") 36.

Reference voltage circuit 31 includes a bias circuit including depression metal-oxide-semiconductor field-effect transistor (hereinafter referred to as DepMOSFET") 311 and MOSFET 312 connected in series to each other such that the gates thereof are connected in common. Reference voltage circuit 31 feeds a reference voltage Vref obtained by dividing the voltage generated by the bias circuit with resistance 313 and resistance 314.

Level shift circuit 32 includes a bias circuit including DepMOSFET 321 and MOSFET 322 connected in series to each other such that the gates thereof are connected in common, MOSFET 323 constituting a current mirror circuit with MOSFET 322, and DepMOSFET 324 connected in series to MOSFET 323. Level shift circuit 32 controls the gate of DepMOSFET 324 with the reference voltage Vref to generate a shifted reference voltage, the level thereof is a predetermined rate of the reference voltage Vref level, and feeds the shifted reference voltage.

Self-interrupter circuit 33 includes a bias circuit including DepMOSFET 331 and MOSFET 332 connected in series to each other such that the gates thereof are connected in common, MOSFET 333 constituting a current mirror circuit with MOSFET 332, MOSFET 334 connected in series to MOSFET 333, and capacitor 335. The ON and OFF of MOSFET 334 is controlled by an interruption signal SD generated by a timer circuit, a temperature detector circuit or such a not-shown anomaly detection means. MOSFET 334 is ON in the usual operations and OFF in the unusual operations. By setting the ON-state resistance of MOSFET 334 to be much lower than the ON-state resistance of MOSFET 333, self-interrupter circuit 33 feeds a shifted reference voltage, obtained by shifting the level of the reference voltage Vref, without further modification in the usual operations. In the unusual operations, self-interrupter circuit 33 lowers the output voltage therefrom gradually by discharging the voltage charged in capacitor 335 by MOSFET 333.

Level shift circuit 34 includes a bias circuit including DepMOSFET 341 and MOSFET 342 connected in series to each other such that the gates thereof are connected in common, MOSFET 343 constituting a current mirror circuit with MOSFET 342, and DepMOSFET 344 connected in series to MOSFET 343. Level shift circuit 34 controls the gate of DepMOSFET 344 with a sensing voltage Vsns detected by converting a current value proportional to the collector current Ic to a voltage value with sensing IGBT 12 and sensing resistance 13. Level shift circuit 34 generates a shifted sensing voltage, the level thereof is a predetermined rate of the sensing voltage Vsns level, and feeds the shifted sensing voltage.

Comparator circuit 35 compares the output from self-interrupter circuit 33 and the output from level shift circuit 34 and controls the ON and OFF of MOSFET 36 based on the results of comparison. When the sensing voltage Vsns, the level thereof is shifted, is equal to or lower than the reference voltage Vref, the level thereof is shifted, MOSFET 36 is turned OFF. When the sensing voltage Vsns, the level thereof is shifted, is higher than reference voltage Vref, the level thereof is shifted, MOSFET 36 is turned ON.

The operations of the ignitor semiconductor apparatus shown in FIG. 5 are described below.

FIGS. 7(A) and 7(B) show operation waveforms relating to the current Ic control. FIG. 7(A) describes the self-interruption operation after the collector current Ic reaches the current limit value Ilim. FIG. 7(B) describes the self-interruption operation in the state, in which the collector current Ic is not so high as to reach the current limit value Ilim. Although the levels of reference voltage Vref and the sensing voltage Vsns are shifted by level shift circuits 32 and 34, for sake of continued clarity, the descriptions in connection with the level shifts are omitted below.

As an ON-signal (e.g. 5 V) is fed from ECU 1 in FIG. 7(A), the collector current Ic flows and the sensing voltage Vsns rises. As the sensing voltage Vsns reaches the reference voltage Vref, MOSFET 36 is turned ON and the gate voltage VGout of output stage IGBT 11 lowers. Comparator circuit 35 controls so that the sensing voltage Vsns may be equal to the reference voltage Vref (at the time t1). Then, as the self-interruption signal SD is fed, the output from self-interrupter circuit 33 lowers gradually from the reference voltage Vref and the gate voltage VGout of output stage IGBT 11 also lowers to keep the relation Vref=Vsns (at the time t2). As the gate voltage VGout of output stage IGBT 11 becomes equal to the threshold voltage Vth of IGBT 11 (e.g., 2 V), self-interrupter circuit 33 interrupts the collector current Ic completely (at the time t3).

The output from self-interrupter circuit 33 drops to around 0 V by the discharge from capacitor 335. However, for keeping the complete interruption of the collector current Ic, it is necessary to maintain the relation Vsns>Vref>0, even when Ic=0. Level shift circuit 34 is disposed for maintaining the relation Vsns>Vref>0. (Level shift circuit 32 is disposed to adjust the reference voltage side characteristics to the sensing side characteristics.) Since the output voltage from self-interrupter circuit 33 keeps falling after the sensing voltage Vsns reaches the lower limit value and becomes constant, the output voltage from comparator circuit 35 rises rapidly after the time t3 and the gate voltage VGout drops rapidly.

In the case, in which the voltage source 4 voltage becomes low and the collector current Ic does not reach the current limit value Ilim as illustrated in FIG. 7(B), a self-interruption signal SD is fed to self-interrupter circuit 33. As self-interrupter circuit 33 starts the self-interruption operation and the reference voltage Vref becomes equal to the sensing voltage Vsns, the gate voltage VGout drops rapidly (at the time t4). The rapid drop of the gate voltage VGout makes the collector current Ic oscillate and spark plug 5 malfunction to spark.

Japanese Unexamined Patent Application Publication No. 2001-153012 (also referred to herein as "Patent Document 1") describes a method for obviating the erroneous ignition caused by the Ic oscillation. The method proposed in Patent Document 1 disposes a series circuit of an IGBT for voltage suppression and a diode for overshoot voltage suppression in parallel to the output stage IGBT. As the collector voltage rises to exceed the breakdown voltage of the diode while the output stage IGBT is operating, the diode breaks down and a current flows through the IGBT for voltage suppression to limit the collector voltage at a constant value.

Japanese Unexamined Patent Application Publication No. 2002-371945 (also referred to herein as "Patent Document 2") describes a voltage monitoring circuit for detecting the collector voltage of an output stage IGBT and a control current adjusting circuit for controlling, with the output from the voltage monitoring circuit, the current that flows to the gate of the output stage IGBT. As the current limitation of the output stage IGBT starts and the collector voltage rises, the voltage monitoring circuit starts operating and the gate voltage of the output stage IGBT is raised via the control current adjusting circuit to suppress the collector voltage rise.

The conventional ignitor apparatuses for internal combustion engines pose the problems as described below.

In the conventional ignitor semiconductor apparatus shown in FIG. 5, the collector current Ic of the output stage IGBT oscillates, while the current control circuit or the self-interrupter circuit is operating, and the spark plug malfunctions to spark.

The ignitor semiconductor apparatuses disclosed in the Patent Documents 1 and 2 take countermeasures against the collector current Ic oscillation of the output stage IGBT, while the current control circuit is operating. However, the Patent Documents 1 and 2 describe nothing on the countermeasures against the collector current Ic oscillation of the output stage IGBT, while the self-interrupter circuit is operating. Therefore, the ignitor semiconductor apparatuses disclosed in Patent Documents 1 and 2 can cause problems similar to the problems that the conventional ignitor semiconductor apparatus shown in FIG. 5 causes.

In view of the foregoing, it would be desirable to obviate or minimize the problems described above. It would be also desirable to provide an ignitor semiconductor apparatus that prevents the collector current Ic of an output stage IGBT from oscillating and a spark plug from malfunctioning to spark while a current control circuit or a self-interrupter circuit is operating.

SUMMARY OF THE INVENTION

According to embodiments of the invention, there can be provided a semiconductor apparatus exhibiting a current control function, the semiconductor apparatus including a first insulated gate transistor controlling the ON and OFF of the main current flowing through the first insulated gate transistor with a driving signal fed thereto, a second insulated gate transistor, the ON and OFF thereof being controlled by the driving signal, the second insulated gate transistor including a collector connected in common to the collector of the first insulated gate transistor, a sensing resistance connected in series to the emitter of the second insulated gate transistor and a current control circuit detecting a voltage across the sensing resistance for controlling the main current flowing through the first insulated gate transistor. Also included can be a first gate control circuit, thereto the driving signal is applied and a second gate control circuit, thereto the driving signal is applied, the first and second gate control circuits generating the gate voltages of the first and second insulated gate transistors separately for controlling the gate voltage of the first insulated gate transistor to be higher than the gate voltage of the second insulated gate transistor, when the main current flowing through the first insulated gate transistor is larger than a predetermined value, and for controlling the gate voltage of the first insulated gate transistor to be lower than the gate voltage of the second insulated gate transistor, when the main current flowing through the first insulated gate transistor is smaller than the predetermined value.

According to embodiments of the invention, the first gate control circuit can include a level shift circuit and the second gate control circuit includes a level shift circuit to set a voltage difference between the gate voltages of the first and second insulated gate transistors.

According to embodiments of the invention, the first gate control circuit can include a first voltage divider resistance circuit connected in series between the driving signal and an earth potential and the second gate control circuit can include a second voltage divider resistance circuit connected in series between the driving signal and the earth potential, and a variable resistance circuit including a MOSFET, the gate voltage thereof being controlled by an output from the second voltage divider resistance circuit, and a third voltage divider resistance circuit, the MOSFET and the third voltage divider resistance circuit being connected in series between the driving signal and the earth potential.

According to embodiments of the invention, the first gate control circuit can include the first voltage divider resistance circuit and a semiconductor switching circuit connected in series between the driving signal and the earth potential, and the ON and OFF of the semiconductor switching circuit is controlled by a signal from the current control circuit.

According to embodiments of the invention, the semiconductor apparatus includes a MOSFET or a bipolar transistor, the MOSFET's or the bipolar transistors being used in substitution for the first and second insulated gate transistors.

In certain embodiments, the ignitor semiconductor apparatus can exhibit a current control function according to the invention includes gate control circuits which control the gate voltages of the output stage IGBT and the sensing IGBT, respectively. The ignitor semiconductor apparatus according to embodiments of the invention can compare the collector current of the output stage IGBT with the predetermined current value, sets a voltage difference (offset) between the gate voltages of the output stage IGBT and the sensing IGBT depending on the results of the comparison, and controls the gate voltages of the output stage IGBT and the sensing IGBT for suppressing the collector current oscillation, when the current control circuit or the self-interrupter circuit is operating, and for preventing the spark plug from malfunctioning to spark.

BRIEF DESCRIPTIONS OF THE DRAWINGS

Figure 7A:
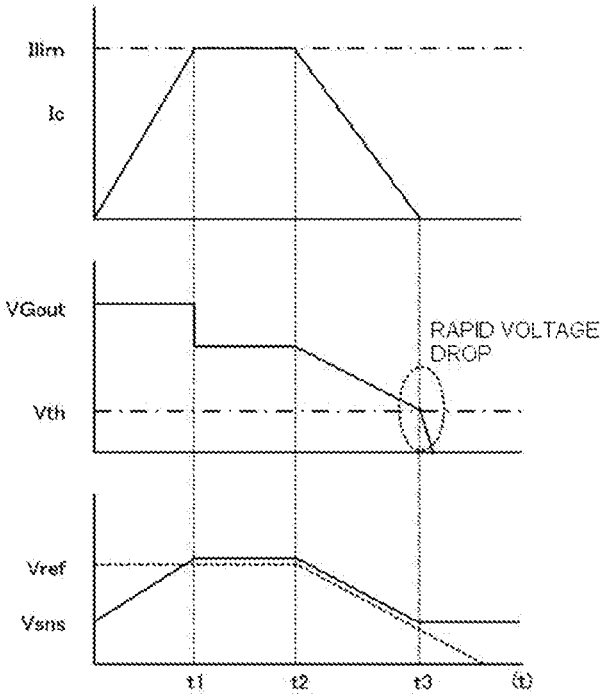
FIG. 7(A) PRIOR ART
Figure 7B:
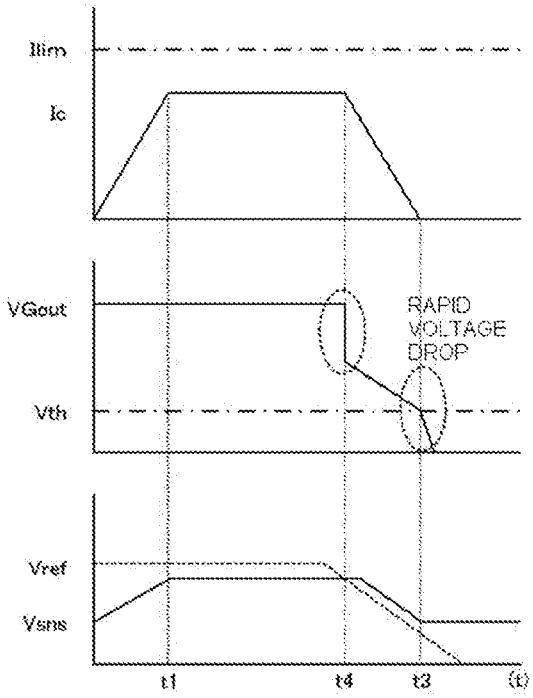
FIG. 7(B) PRIOR ART

FIG. 7(A) illustrates the operation waveforms of the conventional semiconductor apparatus describing the self-interruption operation thereof after the collector current reaches the current limit value; and FIG. 7(B) illustrates the operation waveforms of the conventional semiconductor apparatus describing the self-interruption operation thereof in the state, in which the collector current is not so high as to reach the current limit value.

DETAILED DESCRIPTION

First Embodiment

Embodiments of the invention are described in detail hereinafter with reference to the accompanied drawings which illustrate embodiments of the invention.

Figure 1:
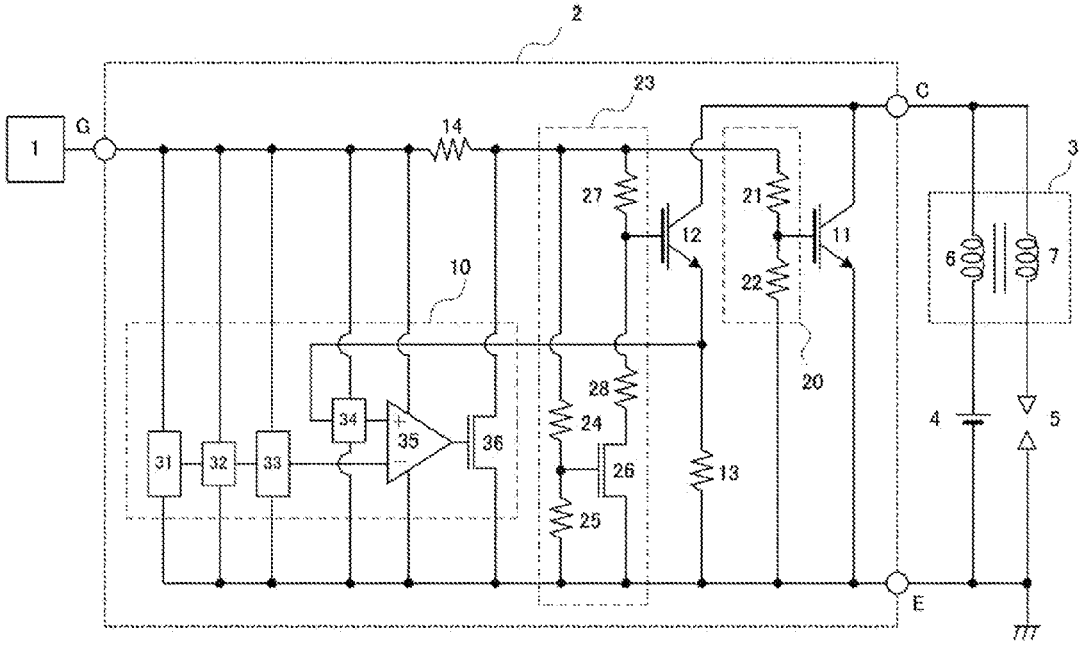
FIG. 1 illustrates a block circuit diagram of a semiconductor apparatus exhibiting a current control function according to a first embodiment of the invention.
Figure 5:
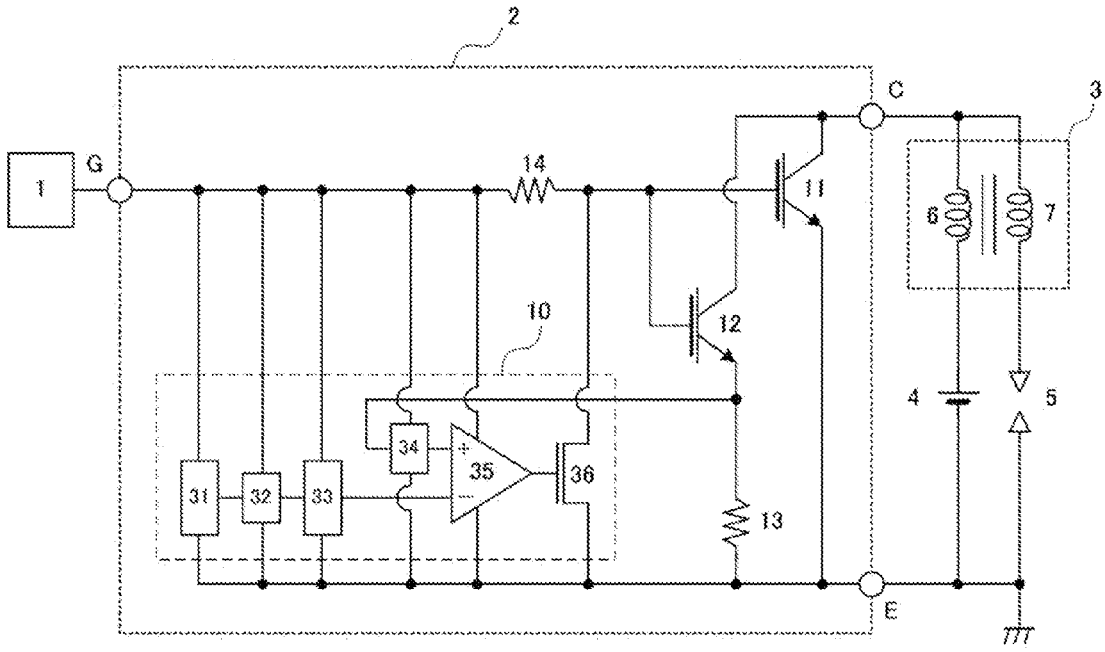
FIG. 5 PRIOR ART
FIG. 5 illustrates a block circuit diagram showing a configuration example of a conventional semiconductor apparatus exhibiting a current control function.

FIG. 1 illustrates the block circuit diagram of an ignitor semiconductor apparatus exhibiting a current control function according to a first embodiment of the invention. In FIG. 1, the same reference numerals as used in FIG. 5 are used to designate the same constituent elements and their duplicated descriptions are omitted for the sake of simplicity.

The ignitor semiconductor apparatus shown in FIG. 1 includes ECU 1, IC 2, ignition coil 3, voltage source 4, and spark plug 5.

Figure 6:
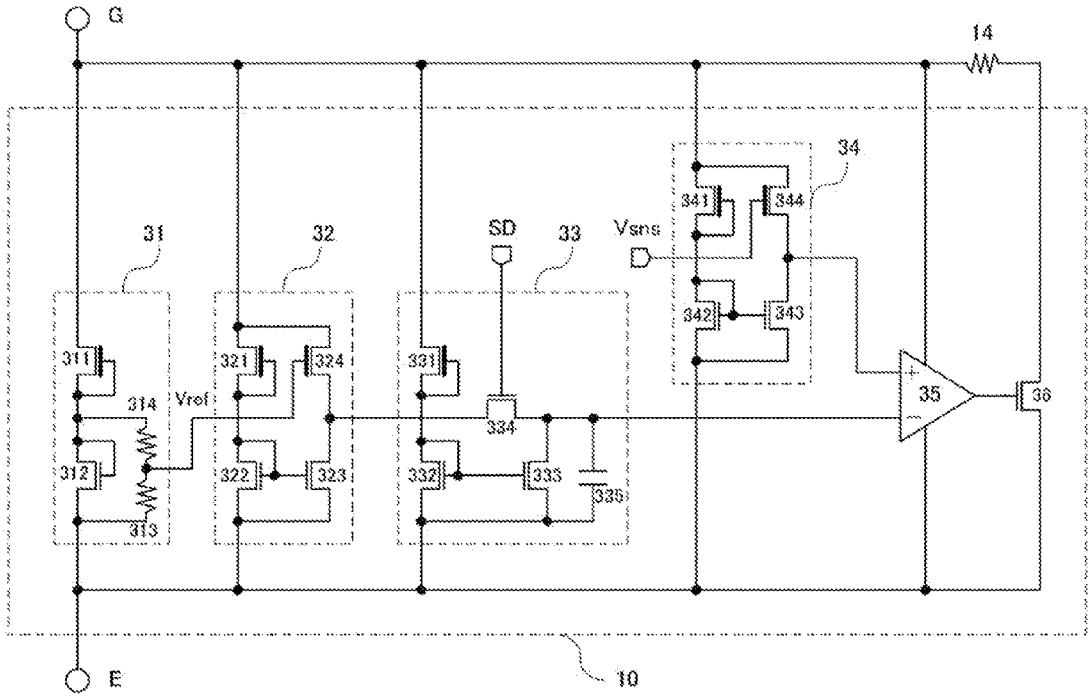
FIG. 6 PRIOR ART
FIG. 6 illustrates a circuit diagram showing the circuit configuration of a conventional current control circuit.

IC 2 includes output stage IGBT 11 that controls the ON and OFF of the ignition coil 3 primary current; sensing IGBT 12 for detecting a sensing current, sensing IGBT 12 being connected to output stage IGBT 11 via the collectors thereof connected in common; sensing resistance 13 for detecting the sensing current; gate resistance 14; current control circuit 10 that controls the collector current Ic of output stage IGBT 11; first gate control circuit 20 that controls the gate voltage VGout of output stage IGBT 11; and second gate control circuit 23 that controls the gate voltage VGsns of sensing IGBT 12. IC 2 further includes three terminals; C terminal (collector electrode), E terminal (emitter electrode), and G terminal (gate electrode). C terminal is connected to ignition coil 3, E terminal to the earth potential, and G terminal to ECU 1. Since current control circuit 10 is the same with the conventional current control circuit shown in FIGS. 5 and 6, the detailed descriptions thereof will be omitted.

First gate control circuit 20 includes a voltage divider resistance circuit including resistance 21 and resistance 22 connected in series between gate resistance 14 connected to G terminal and E terminal. First gate control circuit 20 controls the gate voltage VGout of output stage IGBT 11 with the divided voltage divided by resistance 21 and resistance 22.

Second gate control circuit 23 includes a voltage divider resistance circuit including resistance 24 and resistance 25 connected in series between gate resistance 14 connected to G terminal and E terminal and a variable resistance circuit including resistance 27, resistance 28, and MOSFET 26 connected in series between gate resistance 14 connected to G terminal and E terminal. Second gate control circuit 23 controls the ON-state resistance of MOSFET 26 by driving the MOSFET 26 gate with the divided voltage divided by resistance 24 and resistance 25 to control the resistance value of the variable resistance circuit. Second gate control circuit 23 controls the gate voltage VGsns of sensing IGBT 12 with the divided voltage divided by resistance 27 and resistance 28.

The operations of the ignitor semiconductor apparatus shown in FIG. 1 are be described below.

Figure 2:
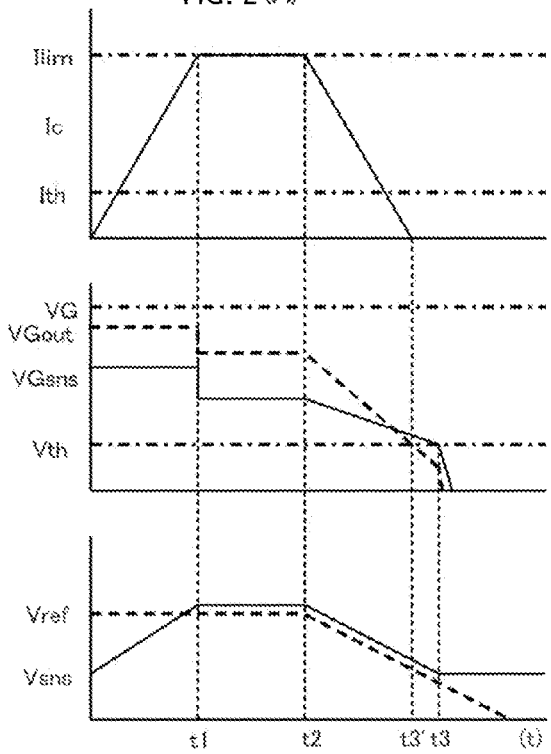
FIG. 2(A) illustrates the operation waveforms of the semiconductor apparatus according to the first embodiment describing the self-interruption operation thereof after the collector current reaches the current limit value.
FIG. 2(B) illustrates the operation waveforms of the semiconductor apparatus according to the first embodiment describing the self-interruption operation thereof in the state, in which the collector current is not so high as to reach the current limit value.
Figure 2:
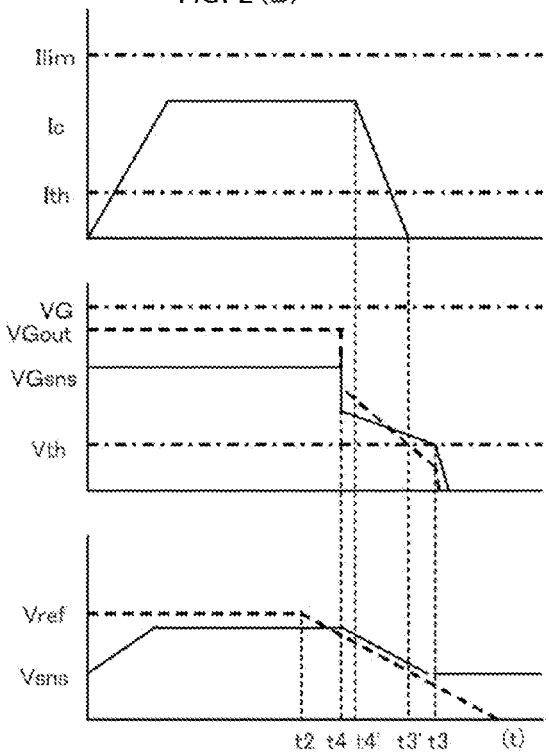

FIGS. 2(A) and 2(B) show, in the same manner as FIGS. 7(A) and 7(B), the operation waveforms relating to the current Ic control. FIG. 2(A) describes the self-interruption operation after the collector current Ic reaches the current limit value Ilim. FIG. 2(B) describes the self-interruption operation in the state, in which the collector current Ic is not so high as to reach the current limit value Ilim. The operations described in FIGS. 2(A) and 2(B) are different greatly from the operations described in FIGS. 7(A) and 7(B) in that first gate control circuit 20 and second gate control circuit 23 generate and control the gate voltages VGout and VGsns of output stage and sensing IGBT's 11 and 12 separately. Although the levels of the reference voltage Vref and the sensing voltage Vsns are shifted by level shift circuits 32 and 34, the descriptions in connection with the level shifts will be omitted below.

First, the operations described in FIG. 2(B) will be explained below.

At the time t2, at which a self-interruption signal SD is fed to self-interrupter circuit 33 and self-interrupter circuit 33 starts the self-interruption operation, the resistance value ratios in first and second gate control circuits 20 and 23 are set so that the gate voltage VGout of output stage IGBT 11 may be higher than the gate voltage VGsns of sensing IGBT 12 (VGout>VGsns).

If the ratio of resistance 24 and resistance 25 is set to be 50:50 in the case, in which the G terminal voltage VG is 5 V, the ON-state resistance of MOSFET 26 will be negligible, since the MOSFET 26 gate is driven by the gate voltage higher than the threshold voltage (e.g., 1 V). If the ratio of resistance 27 and resistance 28 is set to be 20:80 and the ratio of resistance 21 and resistance 22 to be 10:90, the gate voltage VGout of output stage IGBT 11 will be higher than gate voltage VGsns of sensing IGBT 12 (VGout>VGsns).

As the self-interruption operation starts and the reference voltage Vref lowers gradually and becomes equal to the sensing voltage Vsns, the gate voltage VGout of output stage IGBT 11 and the gate voltage VGsns of sensing IGBT 12 drop rapidly (at the time t4) and, then, lower gradually. Since the relation VGout>VGsns holds immediately after the time t4, the collector current Ic does not lower yet. After the gate voltage VGout falls for the potential difference (offset) between the gate voltages VGout and VGsns, the collector current Ic starts falling (at the time t4'). Even if the gate voltage VGout drops rapidly, the collector current Ic will not oscillate, since the gate voltage VGout variation does not affect the collector current Ic at the time t4.

If the gate voltages VGout and VGsns of output stage IGBT 11 and sensing IGBT 12 lower gradually, the ON-state resistance of MOSFET 26 will not be ignorable and the gate voltage difference (offset) between output stage IGBT 11 and sensing IGBT 12 will reduce gradually, since the gate voltage of MOSFET 26 also lowers.

If the resistance ratios are set as described above, when the gate voltages VGout and VGsns of output stage IGBT 11 and sensing IGBT 12 become equal to each other (VGout=VGsns), that is when the collector current Ic becomes equal to the lower limit current value Ith, the gate voltage VGout will be lower than the gate voltage VGsns (VGout<VGsns), when the collector current Ic is smaller than the lower limit current value Ith. Therefore, the sensing voltage Vsns reaches the lower limit value (at the time t3), after the gate voltage VGout falls to the threshold voltage value Vth (e.g. 2 V) and the collector current Ic becomes equal to 0 (at the time t3'). Since the rapid change of the gate voltage VGout occurs at the time t3 after the collector current Ic becomes equal to 0 at the time t3', the self-interruption operation that does not cause any Ic oscillation is realized.

The self-interruption operation in FIG. 2(A) after the collector current Ic reaches the current limit value Him is different from the self-interruption operation in FIG. 2(B) in that the gate voltages VGout and VGsns fall gradually immediately after the self-interruption operation starts at the time t2. The self-interruption operation in FIG. 2(A) after the gate voltages VGout and VGsns fall gradually is the same with the self-interruption operation in FIG. 2(B) after the time t4'.

Second Embodiment

Figure 3:
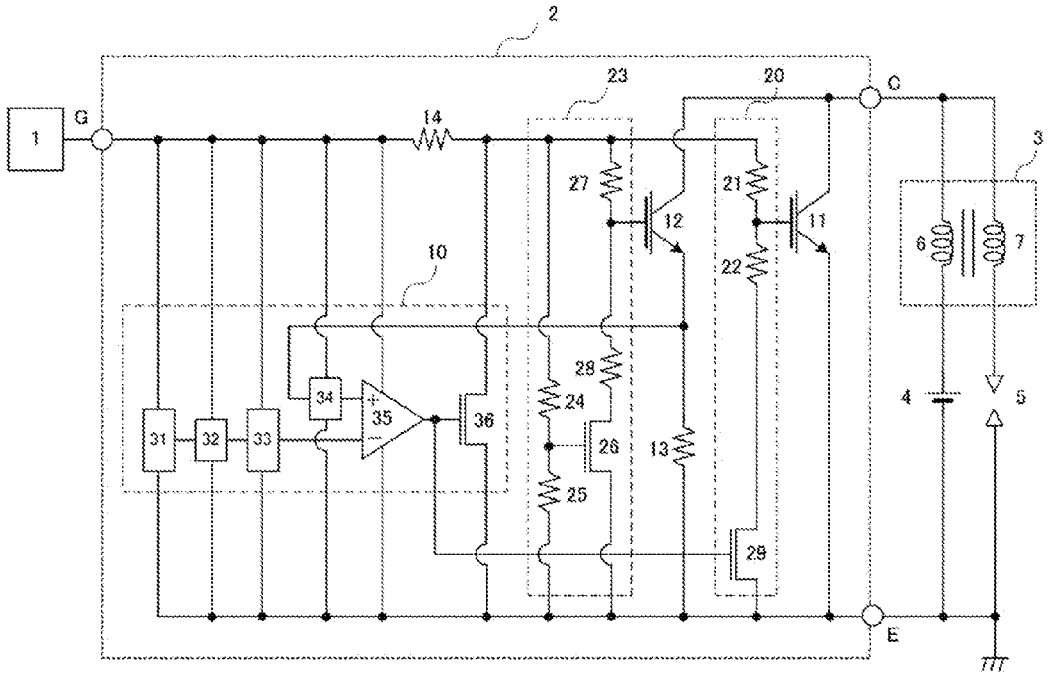
FIG. 3 illustrates the block circuit diagram of a semiconductor apparatus exhibiting a current control function according to a second embodiment of the invention.

FIG. 3 illustrates the block circuit diagram of an ignitor semiconductor apparatus exhibiting a current control function according to a second embodiment of the invention. In FIG. 3, the same reference numerals as used in FIG. 1 are used to designate the same constituent elements and their duplicated descriptions are omitted for the sake of simplicity.

The ignitor semiconductor apparatus shown in FIG. 3 includes ECU 1, IC 2, ignition coil 3, voltage source 4, and spark plug 5.

IC 2 includes output stage IGBT 11, sensing IGBT 12, sensing resistance 13, gate resistance 14, current control circuit 10, first gate control circuit 20, and second gate control circuit 23. IC 2 further includes three terminals; C terminal (collector electrode), E terminal (emitter electrode), and G terminal (gate electrode). C terminal is connected to ignition coil 3, E terminal to the earth potential, and G terminal to ECU 1.

The block circuit diagram shown in FIG. 3 and describing the circuit configuration of IC 2 is different from the block circuit diagram according to the first embodiment shown in FIG. 1 only in that MOSFET 29 is disposed in first gate control circuit 20 as a switching device in FIG. 3.

In detail, first gate control circuit 20 includes a voltage divider resistance circuit including resistance 21, resistance 22, and MOSFET 29 connected in series between gate resistance 14 connected to G terminal and E terminal. First gate control circuit 20 controls the gate voltage VGout of output stage IGBT 11 with the divided voltage divided by resistance 21 and resistance 22. The ON and OFF of the MOSFET 29 gate is controlled by the output from comparator circuit 35. MOSFET 29 is brought into the ON-state thereof in the same manner as MOSFET 36, as the sensing voltage Vsns becomes larger than the reference voltage Vref.

The operations of the ignitor semiconductor apparatus shown in FIG. 3 is described below.

Figure 4A:
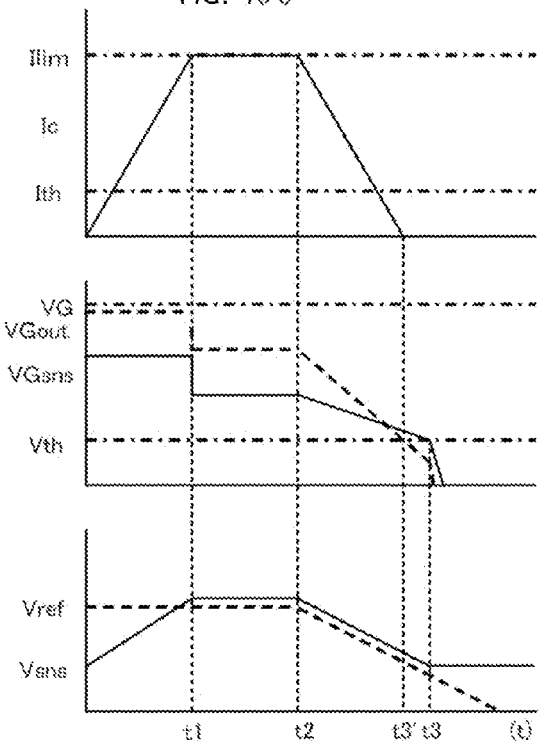
FIG. 4(A) illustrates the operation waveforms of the semiconductor apparatus according to the second embodiment describing the self-interruption operation thereof after the collector current reaches the current limit value.
Figure 4B:
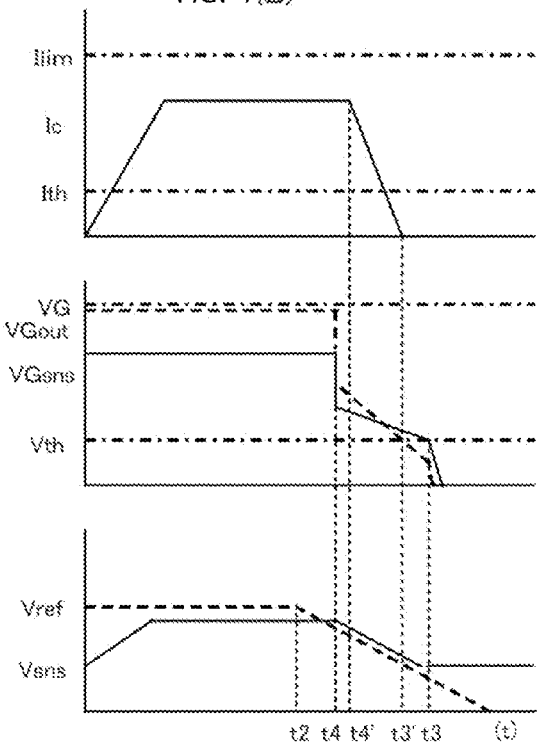
FIG. 4(B) illustrates the operation waveforms of the semiconductor apparatus according to the second embodiment describing the self-interruption operation thereof in the state, in which the collector current is not so high as to reach the current limit value.

FIGS. 4(A) and 4(B) show, in the same manner as FIGS. 2(A) and 2(B), the operation waveforms relating to the current Ic control. FIG. 4(A) describes the self-interruption operation after the collector current Ic reaches the current limit value Ilim. FIG. 4(B) describes the self-interruption operation in the state, in which the collector current Ic is not so high as to reach the current limit value Ilim.

The operations described in FIGS. 4(A) and 4(B) are different greatly from the operations described in FIGS. 2(A) and 2(B) in the gate voltage VGout level of output stage IGBT 11 when MOSFET 29 in first gate control circuit 20 is OFF.

Since the gate voltage VGout of output stage IGBT 11 is always lower than the G terminal voltage VG according to the first embodiment shown in FIGS. 2(A) and 2(B), it is necessary to employ an IGBT having a wider chip area for making a predetermined collector current Ic flow. Therefore, when the collector current Ic is smaller than a predetermined current value, that is when the sensing voltage Vsns is smaller than the reference voltage Vref (Vsns<Vref), MOSFET 29 is turned off to keep the gate voltage VGout of output stage IGBT 11 at a high value. When the collector current Ic is larger than a predetermined current value (Vsns>Vref) or when the self-interruption operation starts, the operations according to the second embodiment are the same with the operations according to the first embodiment. Therefore, the detailed descriptions on the same operations according to the second embodiment are omitted for the sake of simplicity.

As described above, the ignitor semiconductor apparatuses according to the invention include first gate control circuit 20 that controls the output stage IGBT 11 gate and second gate control circuit 23 that controls the sensing IGBT 12 gate. The ignitor semiconductor apparatuses according to the invention set a voltage difference (offset) between the gate voltages of the output stage and sensing IGBT's depending on the magnitudes of the reference and sensing voltages Vref and Vsns to prevent the Ic oscillation from causing in the self-interruption operation to further facilitate preventing the spark plug from malfunctioning to spark. By disposing MOSFET 29 or such a switching device in first gate control circuit 20, it becomes possible to drive the output stage IGBT 11 gate with a high voltage and to prevent the spark plug from malfunctioning to spark by suppressing the Ic oscillation without enlarging the chip size of the integrated circuit.

Although the invention has been described in connection with the preferred embodiments thereof, changes and modifications are obvious to the persons skilled in the art without departing from the true spirit of the invention. Therefore, the invention should be understood not by the specific descriptions herein but by the appended Claims thereof.

Examples of specific embodiments are illustrated in the accompanying drawings. While the invention is described in conjunction with these specific embodiments, it will be understood that it is not intended to limit the invention to the described embodiments. On the contrary, it is intended to cover alternatives, modifications, and equivalents as may be included within the spirit and scope of the invention as defined by the appended claims. In the above description, specific details are set forth in order to provide a thorough understanding of embodiments of the invention. Embodiments of the invention may be practiced without some or all of these specific details. Further, portions of different embodiments can be combined, as would be understood by one of skill in the art.

This application is based on, and claims priority to, Japanese Patent Application No. 2010-178317, filed on Aug. 9, 2010. The disclosure of the priority application, in its entirety, including the drawings, claims, and the specification thereof, is incorporated herein by reference.

What is claimed is:

1. A semiconductor apparatus exhibiting a current control function, the semiconductor apparatus comprising:

a first insulated gate transistor controlling ON and OFF of a main current flowing through the first insulated gate transistor with a driving signal fed thereto;

a second insulated gate transistor, ON and OFF thereof being controlled by the driving signal, the second insulated gate transistor comprising a collector connected in common to a collector of the first insulated gate transistor;

a sensing resistance connected in series to an emitter of the second insulated gate transistor;

a current control circuit detecting a voltage across the sensing resistance, whereby to control the main current flowing through the first insulated gate transistor;

a first gate control circuit, the driving signal being applied to the a first gate control circuit; and a second gate control circuit, the driving signal being applied to the a second gate control circuit;

the first and second gate control circuits generating gate voltages of the first and second insulated gate transistors separately, whereby, to control the gate voltage of the first insulated gate transistor to be higher than the gate voltage of the second insulated gate transistor, when the main current flowing through the first insulated gate transistor is larger than a predetermined value, and whereby, to control the gate voltage of the first insulated gate transistor to be lower than the gate voltage of the second insulated gate transistor, when the main current flowing through the first insulated gate transistor is smaller than the predetermined value.

2. The semiconductor apparatus according to claim 1, wherein the first gate control circuit comprises a level shift circuit and the second gate control circuit comprises a level shift circuit, whereby to set a voltage difference between the gate voltages of the first and second insulated gate transistors.

3. The semiconductor apparatus according to claim 2, wherein the first gate control circuit comprises a first voltage divider resistance circuit connected in series between the driving signal and an earth potential;

and the second gate control circuit comprises a second voltage divider resistance circuit connected in series between the driving signal and the earth potential, and a variable resistance circuit comprising a MOSFET, a gate voltage thereof being controlled by an output from the second voltage divider resistance circuit, and a third voltage divider resistance circuit, the MOSFET and the third voltage divider resistance circuit being connected in series between the driving signal and the earth potential.

4. The semiconductor apparatus according to claim 1, wherein the first gate control circuit comprises a first voltage divider resistance circuit connected in series between the driving signal and an earth potential;

and the second gate control circuit comprises a second voltage divider resistance circuit connected in series between the driving signal and the earth potential, and a variable resistance circuit comprising a MOSFET, a gate voltage thereof being controlled by an output from the second voltage divider resistance circuit, and a third voltage divider resistance circuit, the MOSFET and the third voltage divider resistance circuit being connected in series between the driving signal and the earth potential.

5. The semiconductor apparatus according to claim 3, wherein the first gate control circuit comprises the first voltage divider resistance circuit and a semiconductor switching circuit connected in series between the driving signal and the earth potential, and wherein, ON and OFF control of the semiconductor switching circuit is controlled by a signal from the current control circuit.

6. A semiconductor apparatus exhibiting a current control function, the semiconductor apparatus comprising:

a first transistor controlling ON and OFF of a main current flowing through the first transistor with a driving signal fed thereto;

a second transistor, ON and OFF thereof being controlled by the driving signal, the second transistor comprising a collector connected in common to a collector of the first transistor;

a sensing resistance connected in series to an emitter of the second transistor;

a current control circuit detecting a voltage across the sensing resistance, whereby to control the main current flowing through the first transistor;

a first gate control circuit, the driving signal being applied to the a first gate control circuit; and a second gate control circuit, the driving signal being applied to the a second gate control circuit;

the first and second gate control circuits generating gate voltages of the first and second transistors separately, whereby, to control the gate voltage of the first transistor to be higher than the gate voltage of the second transistor, when the main current flowing through the first transistor is larger than a predetermined value, and whereby, to control the gate voltage of the first transistor to be lower than the gate voltage of the second transistor, when the main current flowing through the first transistor is smaller than the predetermined value.

7. The semiconductor apparatus according to claim 6, wherein the first and second transistors are MOSFET transistors.

8. The semiconductor apparatus according to claim 6, wherein the first and second transistors are bipolar transistors.

* * * * *